US012617584B2

(12) United States Patent
Umbrell

(10) Patent No.: US 12,617,584 B2
(45) Date of Patent: May 5, 2026

(54) PACKAGING FOR A BUFFING PAD

(71) Applicant: Buff and Shine Manufacturing, Inc., Rancho Domnguez, CA (US)

(72) Inventor: Richard Umbrell, Rancho Dominguez, CA (US)

(73) Assignee: Buff and Shine Mfg, Inc.

( * ) Notice: Subject to any disclaimer, the term of this patent is extended or adjusted under 35 U.S.C. 154(b) by 79 days.

(21) Appl. No.: 18/376,794

(22) Filed: Oct. 4, 2023

(65) Prior Publication Data

US 2025/0115396 A1 Apr. 10, 2025

(51) Int. Cl.
*B65D 25/54* (2006.01)
*B65D 75/52* (2006.01)

(52) U.S. Cl.
CPC ..... *B65D 25/54* (2013.01); *B65D 75/522* (2013.01); *B65D 2203/12* (2013.01)

(58) Field of Classification Search
CPC ..... B65D 25/54; B65D 75/26; B65D 75/522; B65D 75/5827; B65D 81/18; B65D 2203/12
USPC ..... 206/361, 459.5, 776–778
See application file for complete search history.

(56) References Cited

U.S. PATENT DOCUMENTS

| | | | | | |
|---|---|---|---|---|---|
| 5,485,918 | A * | 1/1996 | Lasenby | B65D 5/504 | 206/372 |
| 5,878,881 | A * | 3/1999 | Hunt | A47L 13/51 | 220/571.1 |
| 7,611,011 | B2 * | 11/2009 | Skoufis | C11D 3/3947 | 206/229 |
| 11,242,184 | B2 * | 2/2022 | Valentini | B32B 1/00 | |
| 2007/0000214 | A1 * | 1/2007 | Schwabel | B24D 5/12 | 53/472 |
| 2008/0087563 | A1 * | 4/2008 | Kim | B65D 5/4204 | 206/278 |
| 2011/0142377 | A1 * | 6/2011 | Bradley | B32B 27/10 | 383/106 |
| 2012/0031809 | A1 * | 2/2012 | Methe | B65D 75/522 | 206/703 |

* cited by examiner

*Primary Examiner* — Luan K Bui
(74) *Attorney, Agent, or Firm* — Fitzsimmons IP Law

(57) ABSTRACT

A packaging system for a buffing pad is provided where a single package can be used with different types of pads. In one embodiment, a rear perspective view of a pad is provided on the face of the package, where common portions are printed. A transparent portion is further provided whose size and shape resembles uncommon portions of the pad, such as color and texture. The buffing pad is then inserted into the package so that the front surface of the pad is visible through the transparent portion. This will provide the user with a depiction of a buffing pad that is include therein, including its color and texture and its backside, including how the pad can be affixed to a power tool. This together with a legend will allow the user to identify the specific type of buffing pad that is included therein.

20 Claims, 7 Drawing Sheets

PACKAGING FOR A BUFFING PAD

BACKGROUND OF THE INVENTION

1. Field of the Invention

The present invention is directed toward packaging for a buffing pad, and more particularly, to a system and method of using a single package to encase (e.g., for sale, distribution, etc.) different buffing pads by printing portions that are common to each buffing pad on the front of the package and using a window (or a transparent portion) on the front of the package to show portions that are unique to the buffing pad that is inside, where the face of the package includes a rear perspective view of the buffing image and the front surface of the enclosed buffing pad is used to illustrate the color and texture of the side (or edge) of the buffing pad, thereby providing an accurate depiction of the item included therein.

2. Description of Related Art

Buffing refers to the application of a chemical or compound to a surface using a buffing pad. In the automotive detailing industry, for example, buffing is used to repair, refinish or polish the exterior surfaces of automobiles. Buffing can be done by hand, however, professionals and consumers alike prefer to use buffing pads with power buffers. A power buffer can be pneumatic, in which the power is supplied by an air compressor, or motorized, in which the power is supplied by an electric motor. A motorized power buffer is a hand-held tool having a buffing pad attached to a spindle that extends from the electric motor. The motor spins the buffing pad and thus results in faster performance, while reducing fatigue on the operator. It also allows the operator to get optimum finishing effects as compared to buffing by hand.

There are two types of motorized power buffers including high-speed rotary buffers and dual-action or random orbital buffers. The main difference between the two relates to the direction of the rotation of the buffing pad assembly, which in turn produces different results. High-speed buffers provide a circular motion, spinning at very high continuous revolutions per minute (RPMs) and can have either one or two buffing pads attached to the motor. Dual-action or random-orbital buffers turn in a combined circular and orbital motion, at varying speeds. The continuous revolutions of either type of buffer causes friction on contact with the surface producing heat, that when combined with a compound alters the surface of the automobile.

Buffing pads are usually circular and are made in varying sizes. See, e.g., FIG. 1B. They generally include a front (flat) surface that can be used to remove scratches, polish, etc., and a rear (flat) surface that allows the buffing pad to be attached to a power tool (e.g., motorized power buffer). The front surface may be made from various materials, including open or closed cell synthetic foam, microfibers, natural wool, etc. Buffing pads may also include edges (rounded or flat) (providing a buffing pad profile) constructed from the same material. This allows a user to "buff" or "polish" both flat surfaces (using the flat front surface) and nooks and crannies (using the edges). The rear surface of the buffing pad is configured to be attached to the motorized power buffer. This can be done via threads, adhesive, or hook-and-loop fasteners, commonly referred to as Velcro®.

Different buffing pads are used for different applications. For example, under a microscope, foam pads look like a bee's honeycomb, with small uniformly shaped cells. The smaller the cells, the more densely the construction. A small cell foam pad would be considered less aggressive and considered a finishing pad. The opposite effect takes place if the foam cells are larger, or less dense. This construction is more aggressive and would generally be referred to as a compounding pad. Obviously, there are various grades of foam pads on either side of the aggressive or finishing scale.

To increase shelf life and maintain product integrity, buffing pads are generally packaged in an airtight container that is opaque to prevent (or minimizes) exposure to light. This creates a problem in that different types of buffing pads require different types of packaging (e.g., to properly identify the contents, etc.). This can be seen, for example, in FIG. 1A, where the package 10 includes print on its face 20 that identifies various aspects of the item included therein (e.g., the item's identifier, manufacturer, a picture of the item, etc.). As the packaging must be unique to the item included therein, this makes the product more difficult and costly to manufacture.

Thus, it would be advantageous for a new and improved packaging system that not only minimizes (or reduces) light exposure but allows the same packaging to be used with different types of buffing pads. It would also be beneficial for the packaging to illustrate both the product that is included therein (e.g., a buffing pad) and its preferred application (e.g., medium cut, polishing, finishing, etc.). This can be achieved by using a combination of print and transparency on the face of the package, where print is used to illustrate common portions of the pad and transparency is used to illustrate portions that are unique to pad (e.g., color, texture, etc.). In one embodiment, this is achieved by using a front surface of the pad that is included therein to depict a rear perspective view of the side (or edge) of the pad in an image on the face of the packaging.

SUMMARY OF THE INVENTION

The present invention provides a package that can be used to encase different buffing pads by printing portions that are common to each buffing pad on the face of the package and using a window (or a transparent portion) on the face to show portions that are unique to the buffing pad that is inside. In preferred embodiments of the present invention, the pad depicted on the face of the package is shown in a rear prospective view, where the backside is printed and a rear view of the edges are transparent, allowing a front surface of the buffing pad (once inserted) to be seen by the consumer therethrough. This provides an optical illusion as the front surface of the buffing pad is used to depict the edges of the buffing image on the face of the package.

In one embodiment of the present invention, each type of buffing pad is color coded (e.g., a yellow pad may be a polishing pad, a white pad may be a finishing pad, a black pad may be a final finishing pad, etc.) and a legend is printed on the face of the package to identify the type of buffing pad that is included therein. For example, a marron color may indicate a medium cut pad, a blue color may indicate a heavy polish pad, a yellow color may indicate a polish/finish pad, etc.

The vast majority of the package (front and back) should be opaque, with printing that identifies, for example, the manufacturer, product identifier, etc., along with an image of the product. The image should preferably be a rear perspective view of the pad to show the edge of the pad along with the backside, which includes a means for affixing the pad to a power tool (e.g., Velcro®) and, in certain instances, a recess. Common portions of the image (e.g., the backside of the pad) should be printed, whereas uncommon portions of the image (e.g., the color and texture of the edge of the pad) should be transparent, thereby allowing the consumer to see the color and texture of the buffing pad that is included therein. This along with the legend would allow a single package to be used with a wide variety of buffing pads (e.g., medium cut, finishing, etc.). Once the buffing pad is inserted into the packaging, the top and bottom can then be sealed, e.g., using cold seal adhesive, a hot seal, etc. Obviously, portions of the packaging can be sealed before and/or after the item is inserted, depending on the manufacturing process.

When the buffing pad is inserted into the package, it is generally the front surface that faces forward (i.e., adjacent the face of the package), not the rear side as preferably depicted on the face of the package. However, since the front surface and the edges (or sides) are both constructed from the same material (at least in preferred embodiments), the front surface can be used to depict the color and texture of the edges, as depicted on the face of the package, which may be constructed from a single sheet of material (poly, polypropylene, etc.). This results in rear perspective (3D) view of a buffing image on the face of the package, even though the buffing pad itself is oriented so that its front surface faces the front (adjacent the face of the package).

This provides several advantages. First, it allows a single package to be used for different types of buffing pads, where the legend and the color and texture of the pad (visible through the transparent portion) provides the user with information on the type of pad enclosed. Second, the user can visually see a portion of the actual pad that is enclosed without exposing the vast majority of the pad to light. If the portion of the front surface is visible via a transparent portion, then an airtight enclosure can be provided. Alternatively, if the portion is visible via an aperture, then the user can actually touch the material (e.g., for texture, etc.) prior to purchase.

Finally, by sizing and shaping the transparent portion to resemble a common rear edge of a buffing pad, printing a common backside of a pad adjacent the transparent portion, and situating the front surface of the buffing pad behind the transparent portion, an exemplary buffing image can be presented on the face of the package where the color and texture of the front surface of the buffing pad is used to represent an edge of the buffing image. As such, the transparent portion should have (1) an inner edge that follows the curvature of the backside of the pad, (2) an outer edge that is substantially similar (curvature wise), and (3) bottom and top edges (connecting the inner and outer edges) resembling a side profile of the buffing pad included therein.

A more complete understanding of the packaging system will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The present invention provides a package that can be used to encase different buffing pads by printing portions that are common to each buffing pad on the front (or face) of the package and using a window (or a transparent portion) to show portions that are unique to the buffing pad inside. In one embodiment, the face of the package includes a rear perspective view of a buffing pad (allowing the consumer to see the attachment means, to ensure that they are purchasing the correct pad) and uses (via an optical illusion) the front surface of the buffing pad to provide color and texture to the rear edges, thereby providing the consumer with an accurate depiction of the item included therein.

Figure 1A:
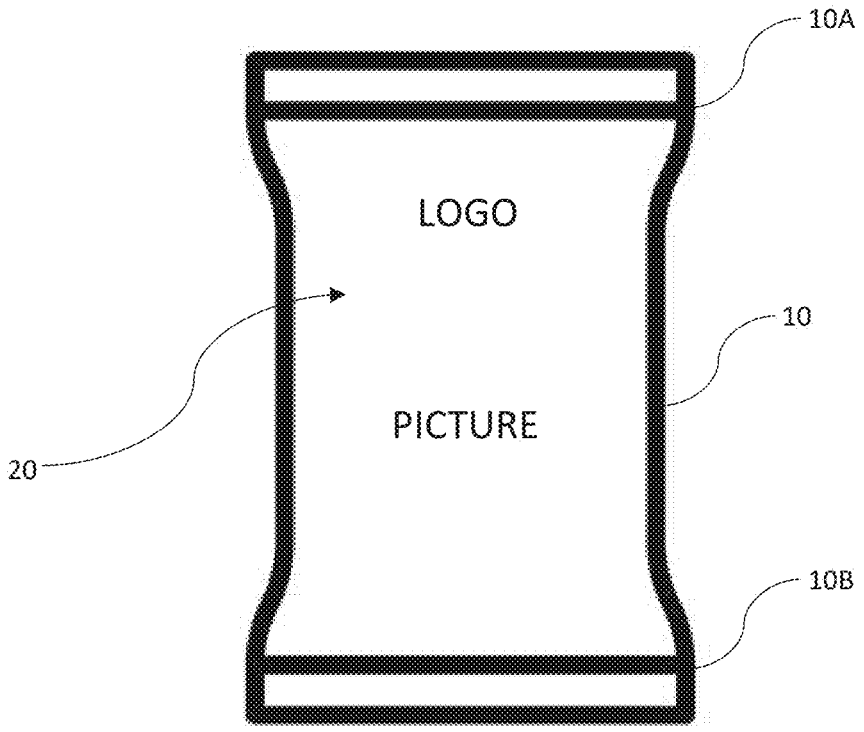
Figure 1A Prior Art
FIG. 1A depicts a prior art package that is sealed at the top and bottom, with optional pictures and text printed on the face of the package.
Figure 1B:
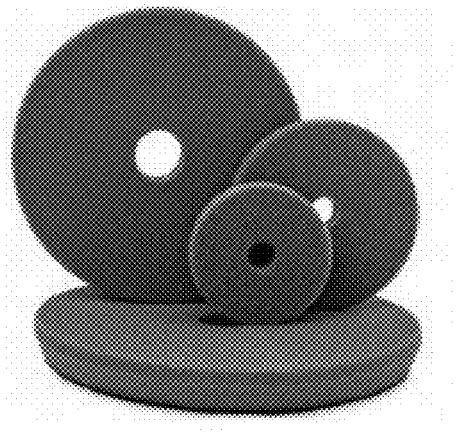
Figure 1B Prior Art
FIG. 1B depicts prior art buffing pads, which may be constructed from different materials and available in different sizes.

As shown in FIG. 1, traditional packaging 10 includes at least one seal (e.g., 10A, 10B) and has a front face 20 where pictures, logos, text, etc. are printed to identify the items included therein. As such, different packaging is required for different items that are included therein. With respect to foam buffing pads, while different ones may appear similar (or even identical to the untrained eye), they generally have different cell sizes (e.g., different densities, etc.) and are designed for different applications.

Figure 2:
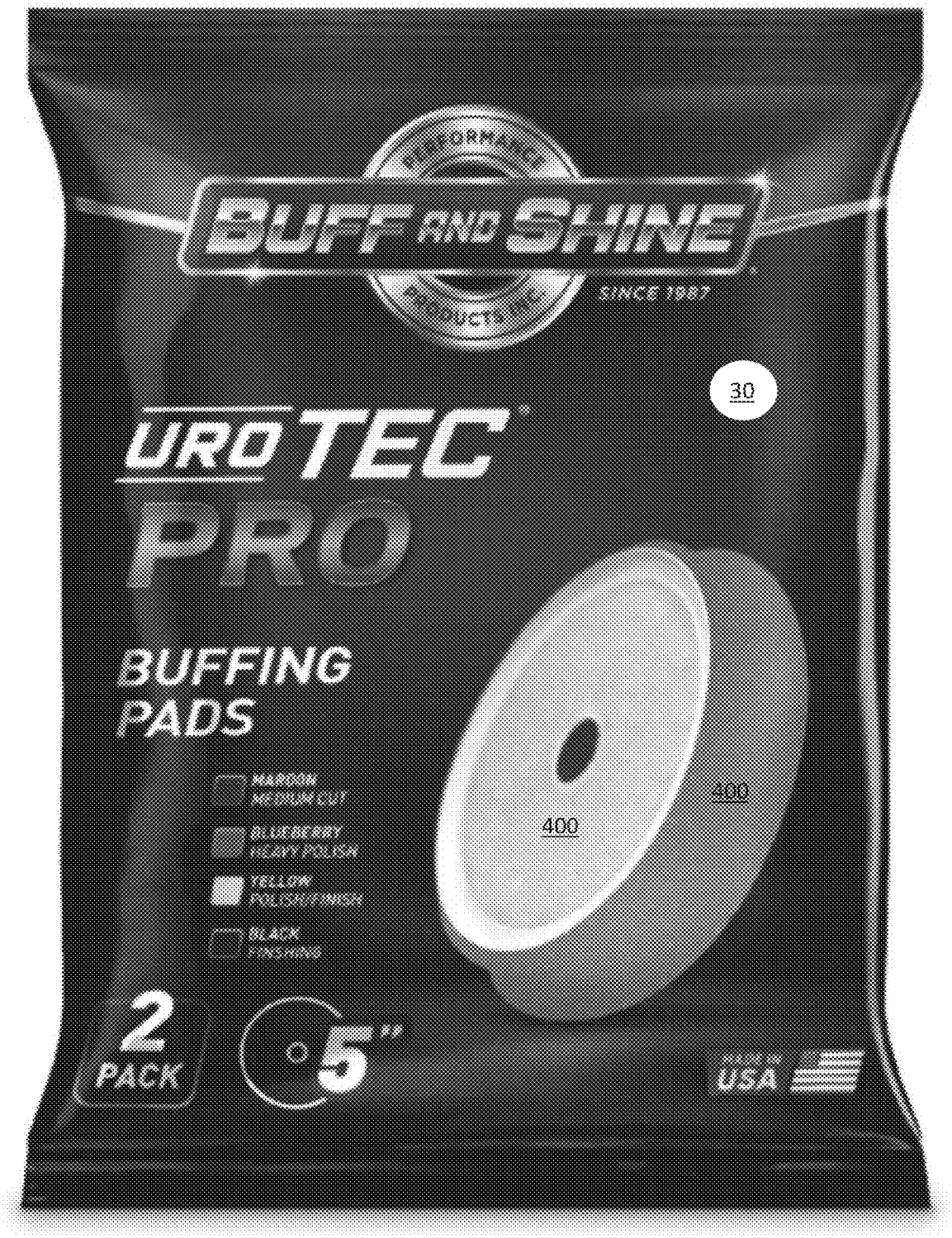
FIG. 2 illustrates one embodiment of the present invention where a rear perspective view of a buffing pad is printed on the face of the packaging, indicating the type of buffing pad that is included therein, along with a color-coded legend for identifying the specific type of buffing pad that is included therein.
Figure 3A:
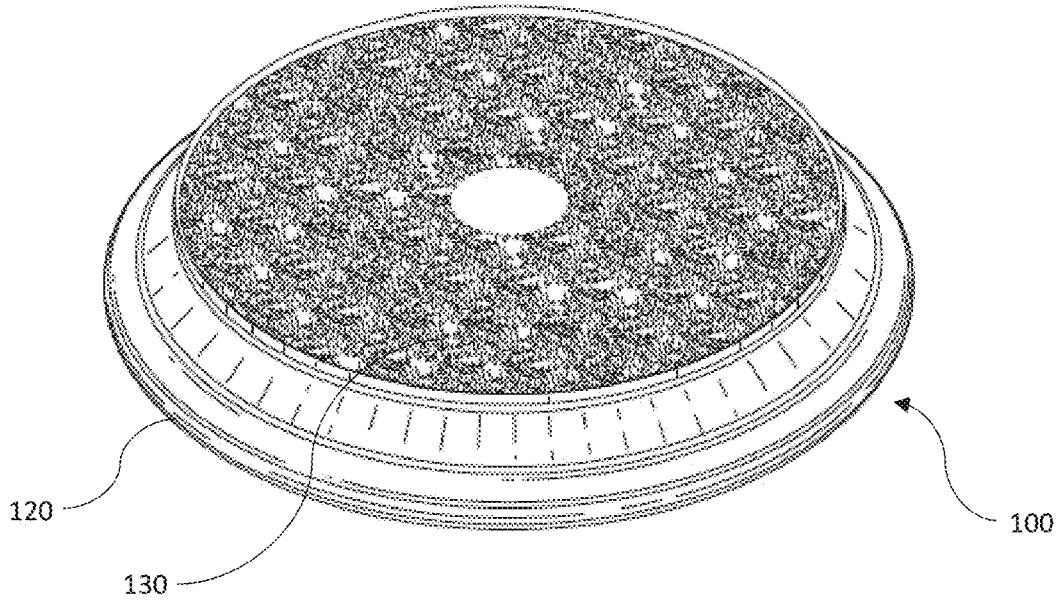
FIGS. 3A-3D illustrate different views of an exemplary buffing pad, including a rear perspective view, a front perspective view, a front plan view, and a side plan view, respectively.
Figure 3B:
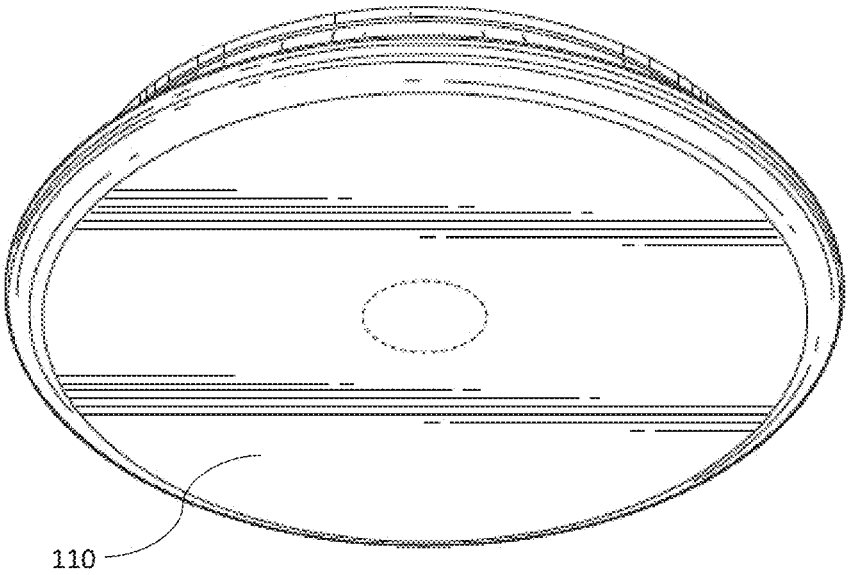
Figure 3C:
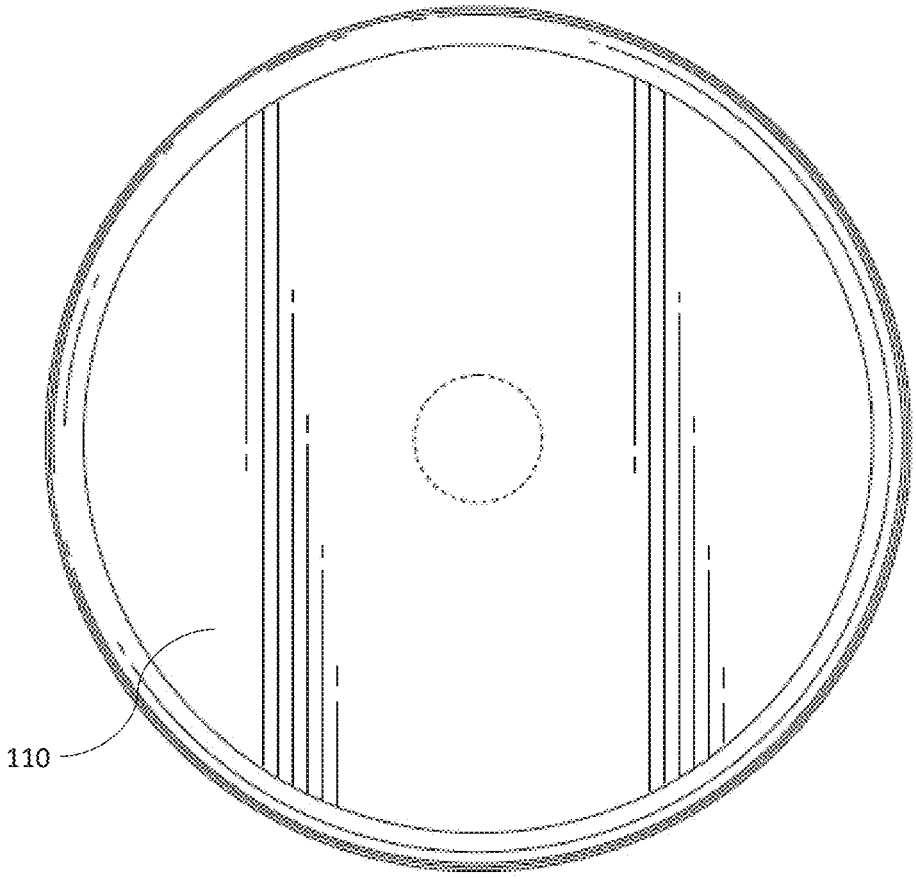
Figure 3D:
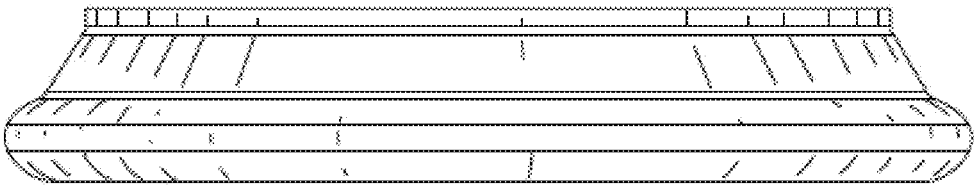

The present invention addresses this drawback by using buffing pads that are color coded (e.g., a yellow pad may be a polishing pad, a white pad may be a finishing pad, a black pad may be a final finishing pad, etc.) and a legend to identify the type of buffing pad that is included inside the package. For example, as shown in FIG. 2, a marron color would indicate a medium cut pad, a blueberry color would indicate a heavy polish pad, a yellow color would indicate a polish/finish pad, and a black color would indicate a finishing pad. Obviously, this legend is exemplary as other legends and/or colors are within the spirit and scope of the present invention.

As shown in FIG. 2, the vast majority of the package (front and back) should be opaque, with printing that identifies, for example, the manufacturer, product name, etc., along with an image of the product 400. The image 400 should preferably be a rear perspective view of the pad to show the (rear) edge of the pad along with the backside, which includes a means for affixing the pad to a power tool (e.g., Velcro®) and, in certain instances, a recess, which may include a patented centering ring (see, e.g., U.S. Pat. No. 8,572,797, assigned to Buff and Shine Manufacturing, Inc.). The face may further include a transparent window 30 (or alternatively an aperture) that would allow the user to see the color and/or texture of the pad that is included therein. This, along with a legend, would allow a single package to be used with a wide variety of buffing pads (e.g., medium cut, finishing, etc.). Once the buffing pad is inserted into the packaging, the top and bottom can then be sealed, e.g., via a cold seal adhesive, hot sealed, or any other sealing technology generally known to those skilled in the art.

It should be appreciated that the packaging shown in FIG. 2 is merely exemplary, and other packaging is within the spirit and scope of the present invention. For example, a package that includes less, more, or different print is within the spirit and scope of the present invention. The transparent portion can also be located elsewhere, with a different shape and/or size. It is preferred that the visible portion be transparent (as opposed to an aperture) to allow the package to be airtight, either vacuum sealed (devoid of air) or filled with air/gas to maintain the products integrity and ensure a sufficiently long shelf life. It should also be appreciated that other transparent portions are within the spirit and scope of the present invention. For example, a second transparent portion could be placed on the back portion of the package (e.g., a square, rectangle, circle, etc.), thereby allowing a user to determine the contents of the package regardless of its orientation. Of course, in this embodiment, the second transparent portion should be located so that a portion of the pad (e.g., an edge or side) can be viewed through the window.

In an alternate embodiment, the transparent portion is a portion of the buffing image that is printed on the face of the package, with common features being printed on the face of the package. To better understand this embodiment, a brief description of an exemplary buffing pad will first be provided.

As shown in FIGS. 3A-3D, the buffing pad 100 may include a front surface 110, edges 120, and a backside 130. The front surface 110 and edges (or sides) 120 may be constructed from a first material, such as foam, microfiber, etc., whereas the backside 130 may be constructed from a second material, such as Veclro®, or some other material that is configured for attachment to a power tool (not shown). When depicting a buffing pad (e.g., on the face of a package), a rear perspective view (FIG. 3A) is preferred as it shows not only the first (buffing) material (via edge 120) but the second (affixing) material (via backside 130). This allows the purchaser to determine whether the buffing pad will work for their application, e.g., when looking for a yellow (polish/finish) pad that can be attached to a power tool via hook-and-loop fasteners.

When the buffing pad 100 is inserted into the package, it is generally the front surface 110 that is adjacent the face of the package; not the rear side as preferably depicted. However, since the front surface 110 and the edges 120 are both constructed from the same material (at least in preferred embodiments), the front surface 110 can be used to depict the color and texture of the edges 120. This results in an optical illusion, using a portion of the front surface 110 of the buffing pad 100 to depict an edge 130 of the buffing pad 100, as depicted on the face of the package.

Figure 4:
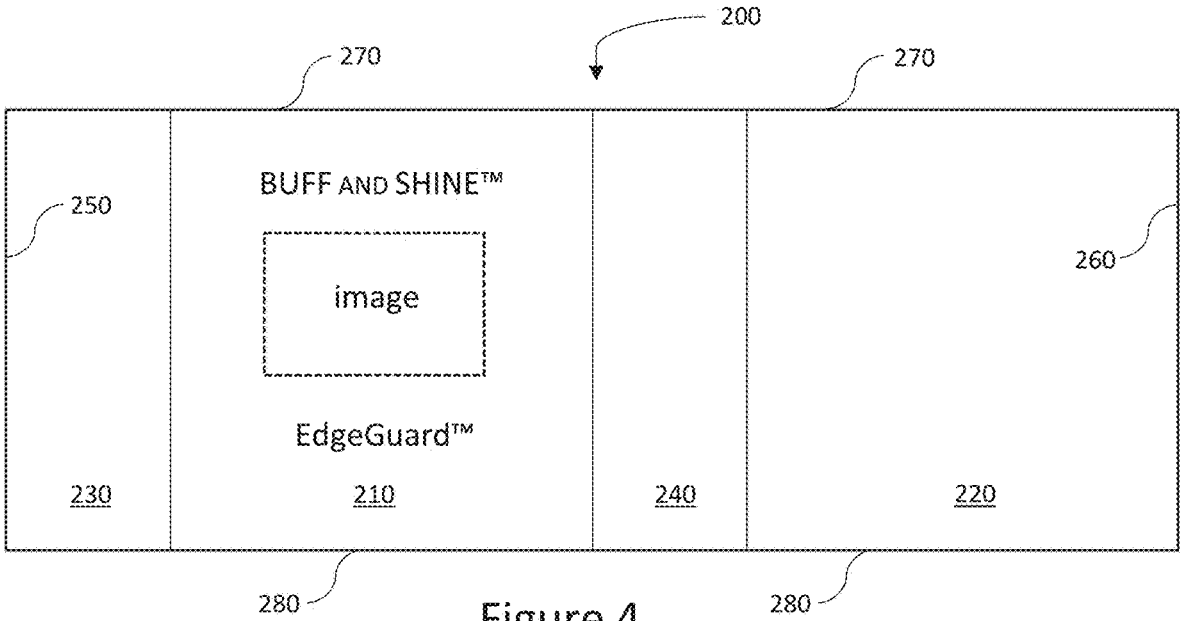
FIG. 4 illustrates one embodiment of the present invention where the packaging comprises a single sheet of material that can folded and sealed (cold or hot) to encase a buffing pad.

While various packaging constructions and materials may be used, in the preferred embodiment, the package is constructed from a single sheet of material (poly, polypropylene, etc.). This is shown in FIG. 4, where the package 200 includes a front portion 210 and a rear portion 220, and perhaps first and second side portions 230, 240. On the front surface 210 (i.e., the face) there is preferably print (e.g., text, images, etc.). The package 200 is constructed by folding the back portion 220 behind the front portion 210. The ends 250, 260 and bottoms 280 are sealed. As discussed above, this can be accomplished via any means generally known to those skilled in the art (e.g., cold sealing, hot sealing, etc.). At least one buffing pad 100 can then be placed inside the package 200 (preferably with the front surface 110 facing the front), and the tops 270 sealed (e.g., using the same or different means). It should be appreciated that this type of packaging is exemplary and other types of packaging (e.g., without sides, alternate materials (e.g., cardboard, etc.) etc.) are within the spirit and scope of the present invention. It should also be appreciated that the number, types, and order of the seals may vary depending on the manufacturing process. For example, the product could first be placed on the material, then folded, ends 250, 260 sealed, followed by the sealing of the tops 270 and bottoms 280.

Figure 5:
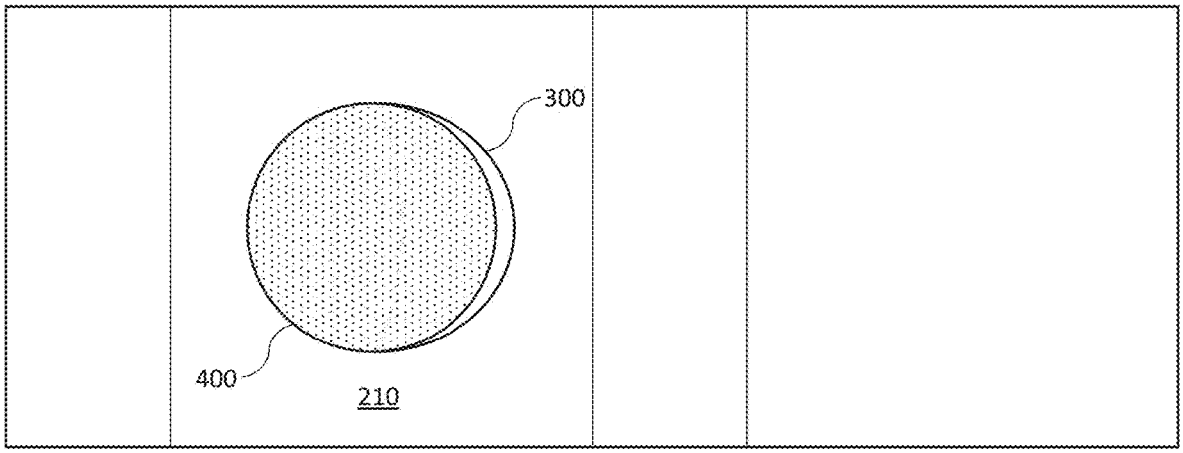
FIGS. 5-8 illustrate how a buffing pad (FIG. 6) can be placed inside a package having a transparent portion (FIG. 5), thereby exposing a portion of the buffing pad that is included therein (FIGS. 7 and 8) to complete an image of the buffing pad from a different perspective.
Figure 6:
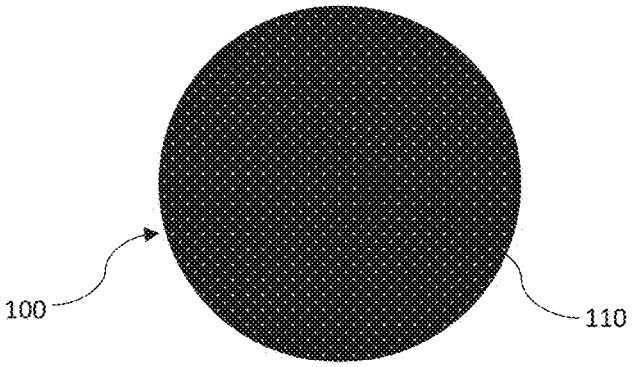
Figure 7:
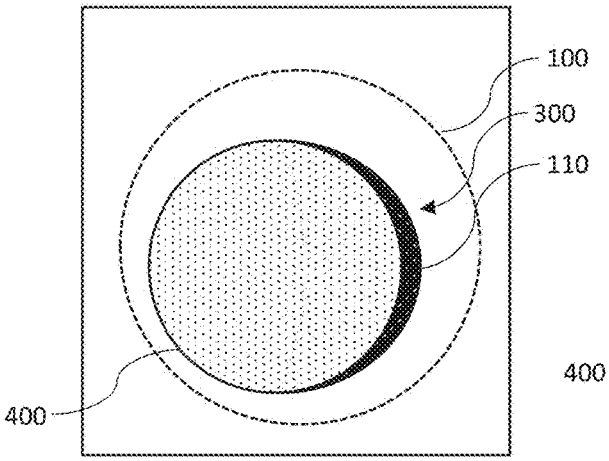
Figure 8:
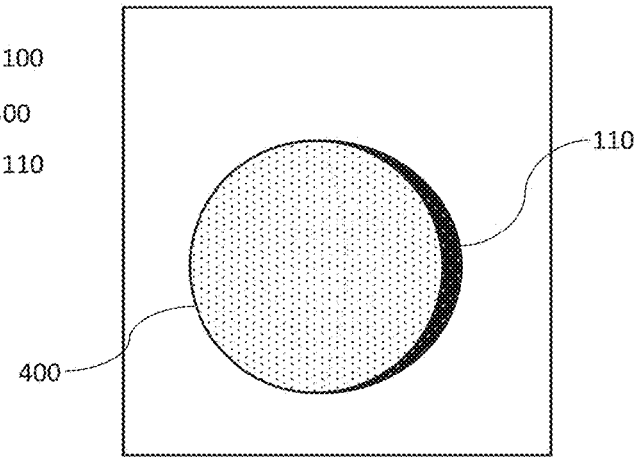
Figure 9:
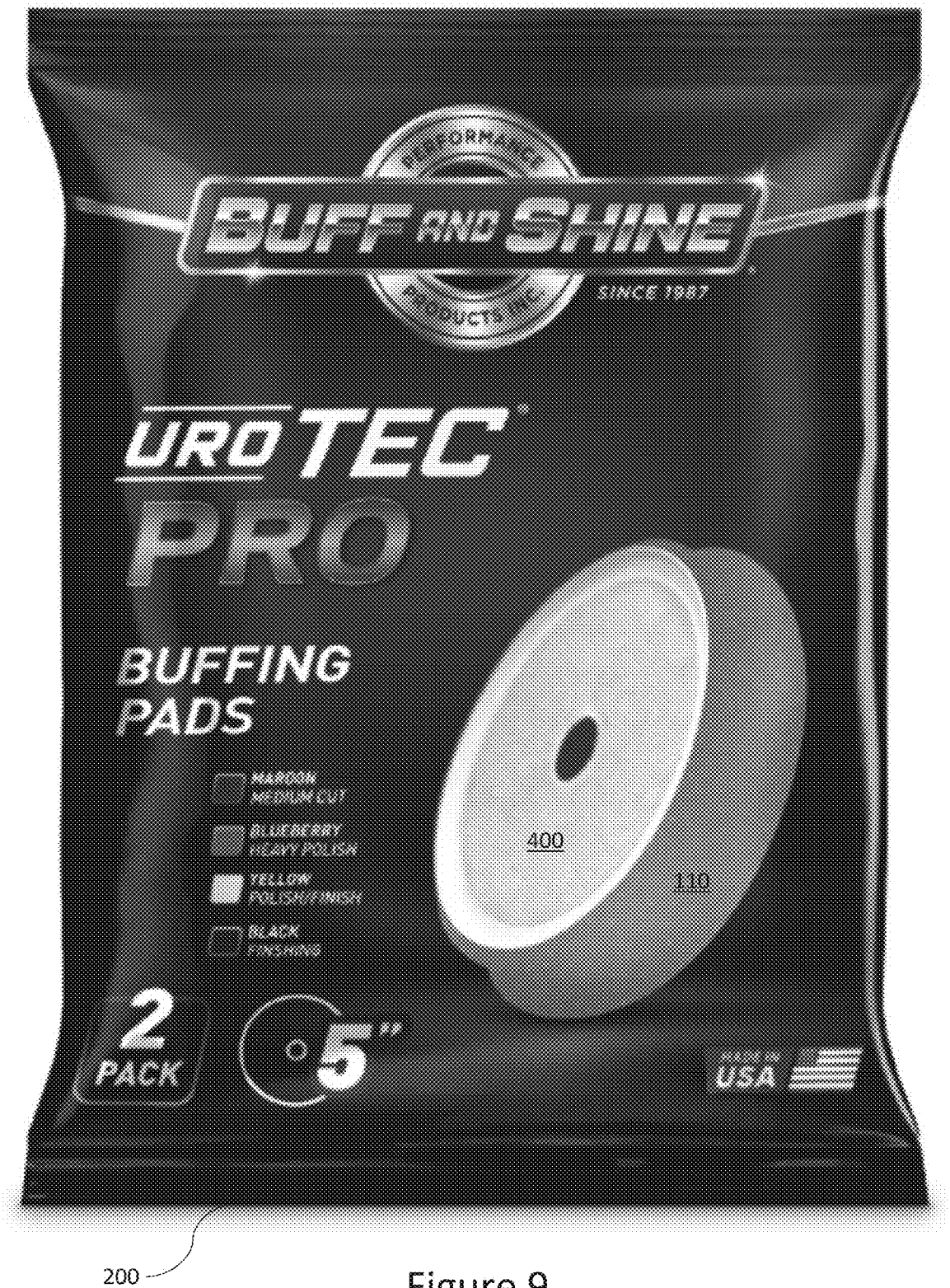
FIG. 9 illustrates one embodiment of the present invention where a rear perspective view of a buffing pad is provided on the face of the packaging using print to depict common portions and transparency to depict unique portions (e.g., color, texture, etc.), along with a color-coded legend to identify the specific type of buffing pad that is included therein.

In a preferred embodiment, as shown in FIG. 5, the front portion 210 of the package 200 includes print 400 and at least one transparent portion (or aperture) 300, where the transparent portion 300 is preferably adjacent the printed portion 400, collectively providing a rear prospective (3D) view of a buffing pad. The buffing pad 100 (FIG. 6) is then inserted into the packaging so that a portion of the front surface 110 of the buffing pad 100 (or a front surface 110 thereof) can be seen through the transparent portion 300 (see FIG. 7). This results in a rear perspective (3D) view of a buffing image having a backside (printed) and edges (transparent), where the front surface 110 of the buffing pad 100 is used to provide color and texture to the (rear) edges of the buffing image (see FIG. 8). This optical illusion can also be seen in FIG. 9, where a backside of a buffing pad 400 is printed on an opaque portion of the face of the package 200 and the front surface 110 of the buffing pad 100 is visible through the transparent portion of the face, providing color and texture to what is presented as the edge (or side) of the buffing image on the face of the package 200.

This provides several advantages. First, it allows a single package to be used to for different types of buffing pads, where the legend and the color and texture of the pad (visible through the transparent portion) provides the user with information on the type of pad enclosed. Second, the user can visually see a portion of the actual pad that is enclosed without exposing the vast majority of the pad to light. If the portion of the front surface 110 is visible via a transparency, then an airtight enclosure can be provided. Alternatively, if the portion is visible via an aperture, then the user can actually touch the material (e.g., for texture, etc.) prior to purchasing the item.

Finally, by sizing and shaping the transparent portion to resemble a common rear edge (or side) of a buffing pad, printing a common backside of a pad adjacent the transparent portion, and situating the front surface 110 of the buffing pad 110 behind the transparent portion, an exemplary pad (buffing image) can be presented on the face of the package where the color and texture of the edge of the exemplary pad is derived from the front surface 110 of the buffing pad 100. As such, the transparent portion should have (1) an inner edge that follows (and is adjacent to) the curvature of the backside of the pad, (2) an outer edge that is spaced apart from and substantially similar to (curvature wise) the inner edge, and (3) bottom and top edges (connecting the inner and outer edges) that resemble a side profile of the buffing pad included therein. The inner and outer edges should also be (1) angled off center (from a perpendicular line that dissects the package) by a degree that matches the angle from which the backside (or outer circumference thereof) is off center and (2) have heights that are greater than a diameter of the backside.

Having thus described preferred embodiments of a single package that can be used to encase different buffing pads, it should be apparent to those skilled in the art that certain advantages have been achieved. It should also be appreciated that various modifications, adaptations, and alternative embodiments thereof may be made within the scope and spirit of the present invention. The invention is further defined by the following claims.

What is claimed is:

1. A packaging system, comprising:

a buffing pad having a front surface and a backside that are both substantially flat, said front surface comprising a first material having a particular color and texture and can be used to buff a surface of a vehicle and said backside comprising a second material configured for affixing said buffing pad to a power tool; and a package comprising at least a front portion and a back portion, said front portion comprising an opaque portion and a transparent portion, wherein said opaque portion has print depicting a rear perspective view of said backside of said buffing pad and said transparent portion has a shape depicting a rear perspective view of a side portion of said buffing pad including an inner edge that follows a curvature of said backside of said buffing pad, an outer edge that has a curvature that is substantially similar to said curvature of said backside of said buffing pad, and bottom and top edges connecting said inner and outer edges;

wherein said buffing pad is placed inside said package so that said front surface of said buffing pad is adjacent said front surface of said package and a portion of said front surface of said buffing pad is visible through said transparent portion thereby providing a user with an optical illusion that said portion of said front surface of said buffing pad is said side portion of said buffing pad, thereby presenting a user with an accurate depiction of a rear perspective view of said buffing pad, including said color and texture of said first material, without having to alter said print on said opaque portion of said package for different buffing pads constructed from different materials.

2. The system of claim 1, wherein said first material is foam and said color is uniform and visible through said transparent portion of said package.

3. The system of claim 1, wherein said first material is microfiber having at least two colors that are visible through said transparent portion of said package.

4. The system of claim 1, wherein said second material is one side of a hook-and-loop fastener.

5. The system of claim 1, wherein said package comprises a single sheet of material that can be folded and sealed to enclose said buffing pad.

6. The system of claim 5, wherein said package further comprises a cold seal adhesive.

7. The system of claim 5, wherein said package is heat sealed to form said enclosure.

8. The system of claim 1, wherein said back portion comprises an opaque portion having print that describes a feature of the buffing pad.

9. The system of claim 8, wherein said print further depicts a ledger having a plurality of colors, each one of said plurality of colors corresponds to a different type of pad and one of said plurality of colors corresponds to said color of said first material.

10. A system for packaging a pad, comprising:

a buffing pad having a front surface and a backside, said front surface comprising a first material that can be used to buff a surface and said backside comprising a second material configured for affixing said buffing pad to a power tool, said second material being Velcro; and a package comprising at least a front portion and a back portion, said front portion comprising a first portion that is opaque and a second portion that allows a user to see the contents of said package, wherein said first portion has print depicting a rear perspective view of said backside of said buffing pad and said second portion has a shape depicting a rear perspective view of a side portion of said buffing pad;

wherein said buffing pad is placed inside said package so that a portion of said front surface of said buffing pad is visible through said second portion, thereby presenting a user with an accurate depiction of a rear perspective view of said buffing pad, including a color and texture of said first material; and wherein said second portion comprises an aperture having said shape, thereby allowing a user to touch said front surface of said buffing pad prior to opening said package.

11. A system for packaging a pad, comprising:

a buffing pad having a front surface and a backside, said front surface comprising a first material that can be used to buff a surface and said backside comprising a second material configured for affixing said buffing pad to a power tool, said second material being Velcro; and a package comprising at least a front portion and a back portion, said front portion comprising a first portion that is opaque and a second portion that allows a user to see the contents of said package, wherein said first portion has print depicting a rear perspective view of said backside of said buffing pad and said second portion has a shape depicting a rear perspective view of a side portion of said buffing pad including an inner edge that follows a curvature of said backside of said buffing pad, an outer edge that has a curvature that is substantially similar to said curvature of said backside of said buffing pad, and bottom and top edges connecting said inner and outer edges;

wherein said buffing pad is placed inside said package so that said front surface of said buffing pad is adjacent said front surface of said package and a portion of said front surface of said buffing pad is visible through said second portion, thereby presenting a user with an optical illusion that said portion of said front surface of said buffing pad is said side portion of said buffing pad, accurately depicting a rear perspective view of an edge of said buffing pad, including a color and texture of said first material.

12. The system of claim 11, wherein said first material is foam and said color is uniform and visible through said transparent portion of said package.

13. The system of claim 11, wherein said first material is microfiber having at least two colors that are visible through said transparent portion of said package.

14. The system of claim 11, wherein said second material is one side of a hook-and-loop fastener.

15. The system of claim 11, wherein said package comprises a single sheet of material that can be folded and sealed to enclose said buffing pad.

16. The system of claim 15, wherein said package further comprises a cold seal adhesive.

17. The system of claim 15, wherein said package is heat sealed to form said enclosure.

18. The system of claim 11, wherein said packaging further comprises print that describes a feature of the buffing pad.

19. The system of claim 18, wherein said print further depicts a ledger having a plurality of colors corresponding to different types of pads with one of said plurality of colors corresponding to said color of said first material.

20. The system of claim 19, wherein said first portion depicts features that are common to said different types of pads and said second portion depicts a feature that is unique to each of said different types of pads.

* * * * *